US008535018B2

(12) United States Patent
Bouvier

(10) Patent No.: US 8,535,018 B2
(45) Date of Patent: Sep. 17, 2013

(54) BALANCING LIQUID PUMPING SYSTEM

(76) Inventor: Jean-Marc Bouvier, Chateauguay (CA)

( * ) Notice: Subject to any disclaimer, the term of this patent is extended or adjusted under 35 U.S.C. 154(b) by 474 days.

(21) Appl. No.: 12/941,417

(22) Filed: Nov. 8, 2010

(65) Prior Publication Data

US 2012/0114507 A1 May 10, 2012

(51) Int. Cl.
*F04F 1/06* (2006.01)
*F04F 3/00* (2006.01)

(52) U.S. Cl.
USPC ..... 417/118

(58) Field of Classification Search
USPC ..... 417/118, 120, 122, 123, 124, 125, 417/54, 56, 90, 95, 96, 108, 138, 143, 144; 137/256
See application file for complete search history.

(56) References Cited

U.S. PATENT DOCUMENTS

| | | | | | |
|---|---|---|---|---|---|
| 506,996 | A * | 10/1893 | Glenn | 417/125 |
| 533,228 | A * | 1/1895 | Merrill | 417/125 |
| 835,391 | A * | 11/1906 | Allison | 417/125 |
| 982,364 | A * | 1/1911 | Hodder | 417/125 |
| 1,409,476 | A * | 3/1922 | Smythe | 417/125 |
| 1,489,635 | A * | 4/1924 | Foster | 417/125 |
| 1,544,347 | A * | 6/1925 | Rogers | 417/125 |
| 1,601,603 | A * | 9/1926 | Evans et al. | 417/125 |
| 2,583,421 | A * | 1/1952 | Glover et al. | 417/99 |
| 2,669,941 | A * | 2/1954 | Stafford | 417/125 |
| 2,821,931 | A * | 2/1958 | Tek | 417/85 |
| 3,730,647 | A * | 5/1973 | Lonardo | 417/122 |
| 3,749,526 | A * | 7/1973 | Ferrentino | 417/390 |
| 3,829,246 | A * | 8/1974 | Hancock | 417/121 |
| 3,967,917 | A * | 7/1976 | Pucher et al. | 417/54 |
| 4,243,102 | A * | 1/1981 | Elfarr | 166/372 |
| 4,310,287 | A * | 1/1982 | Heilenz | 417/54 |
| 4,408,960 | A * | 10/1983 | Allen | 417/54 |
| 5,544,983 | A * | 8/1996 | Taguchi | 406/85 |
| 5,671,813 | A * | 9/1997 | Lima | 166/372 |
| 6,200,104 | B1 * | 3/2001 | Park | 417/118 |
| 6,352,109 | B1 * | 3/2002 | Buckman, Sr. | 166/250.03 |
| 6,976,497 | B2 * | 12/2005 | Gridley | 137/14 |
| 7,100,695 | B2 * | 9/2006 | Reitz | 166/372 |
| 7,673,659 | B2 | 3/2010 | Burkholder | |
| 2005/0068385 | A1 * | 3/2005 | Nanjo et al. | 347/85 |

FOREIGN PATENT DOCUMENTS

| | | |
|---|---|---|
| WO | 2010031162 | 3/2010 |

* cited by examiner

*Primary Examiner* — Devon Kramer
*Assistant Examiner* — Amene Bayou

(57) ABSTRACT

Liquid from a body of liquid is pumped using two liquid columns connected to a sealable conduit containing gas. The liquid columns are also connected to another conduit having a switched valve. Pumping is initiated by extracting gas from the sealed conduit. Liquid exits one of the liquid columns through the switched valve. Lowering of the liquid level in one of the liquid columns moves gas in the sealed conduit. This in turn induces pumping liquid from the body of liquid in another one of the liquid columns. When the liquid level reaches a minimum in the liquid column, the switched valve changes position, blocking a liquid flow from the liquid column and allowing liquid in the other of the liquid column to exit.

20 Claims, 3 Drawing Sheets

BALANCING LIQUID PUMPING SYSTEM

TECHNICAL FIELD

This present disclosure relates to the field of liquid pumping systems, and more specifically, to a pump and a system for pumping liquid using a gas and liquid balancing effect.

BACKGROUND

Liquid and energy are precious resources. In many geographical areas, the most accessible source of liquid is in the form of liquid. A ground water table, defined as a level at which the groundwater pressure is equal to atmospheric pressure, may be found within depths of a few tens of meters in many areas, including in locations that are otherwise far remote from any lake or river. Ground water is generally extracted using electric pumps that are located at the bottom of wells dug into the ground.

Energy, including electrical energy, is costly and may be of limited availability in areas where groundwater needs to be extracted. In some areas, groundwater availability may actually be high while electrical resources are limited and costly. Pumping liquid from other sources, such as a river or a lake also requires energy, which can sometimes be scarce.

Therefore, there is a need for economical techniques for pumping liquid and for generating energy.

SUMMARY

Therefore, according to the present disclosure, there is provided a system for pumping liquid comprising two liquid columns for reaching a body of liquid at their bottom. Each liquid column comprises a liquid level detector and a one-way valve allowing liquid to flow upward. An upper conduit is for sealably connecting at both ends to the top of the two liquid columns. The upper conduit comprises a sealable gas valve for extracting gas from the upper conduit. An actuated conduit is for connecting, at each end, to one of the two liquid columns above its one-way valve. The actuated conduit also comprises, at each end, a one-way valve allowing liquid to flow inward from each of the two liquid columns. The actuated conduit further comprises, between its two one-way valves, a switched valve allowing liquid to flow out of the system from each one-way valve at a time. A controller is for connecting to the liquid level detectors and for controlling the switched valve. As gas is extracted from the upper conduit, liquid in each of the two liquid columns raises to a starting level. As the gas valve is sealed, liquid from one of the liquid columns flows out of the system through the actuated conduit and through the switched valve. Then, as the liquid level in one of the liquid columns reaches a minimum level, the switched valve switches to allow liquid to flow from the other liquid column.

According to the present disclosure, there is also provided a balancing liquid pump. The pump comprises a sealable gas-liquid balancing conduit, two inlet conduits for connecting to a body of liquid at their bottom in unidirectional upward direction and for connecting to the gas-liquid balancing conduit at their top, and two unidirectional inward outlet conduits. Each outlet conduit is for connecting at one end to one of the inlet conduits and at another end to a common switched valve allowing liquid to flow out of the pump from one of the two inlet conduits at a time. A starting system is used for initiating a flow of liquid from the body of liquid and for raising a level of liquid in at least one of the inlet conduits. As liquid flows out of the pump from one of the inlet conduits, a level of liquid that inlet conduit goes down, and gas in the gas-liquid balancing conduit follows the level of liquid in that inlet conduit. This movement of the gas in the gas-liquid balancing conduit pumps liquid from the body of liquid into the other inlet conduit.

BRIEF DESCRIPTION OF THE DRAWINGS

Embodiments of the disclosure will be described by way of example only with reference to the accompanying drawings, in which.

DETAILED DESCRIPTION

Figure 1:
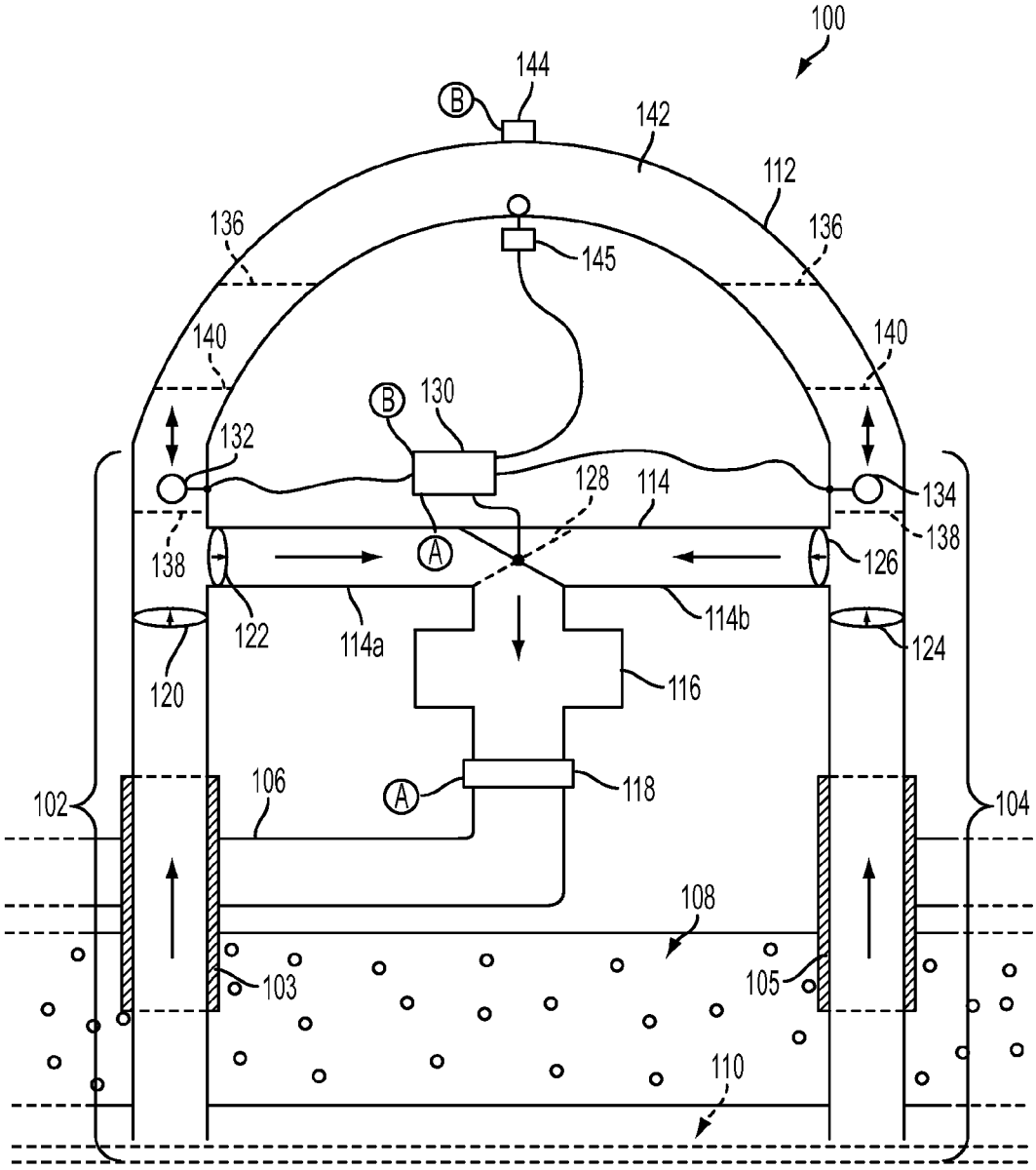
FIG. 1 is a schematic diagram of an exemplary balancing liquid pumping system.

A system for pumping liquid using a balancing effect, also called a balancing liquid pump, comprises two liquid columns reaching a body of liquid at their bottom and connected at their top by a sealable upper connecting conduit that contains gas. The term 'gas' is used throughout the present specification and claims for simplicity purposes, but it is used to refer to any of the following: ambient air, filtered air, an inert gas, or any other gas. Gas within the upper connecting conduit moves as liquid levels change within the liquid columns. The liquid columns may be formed of pipes dug into the ground, for example steel or plastic pipes, similar to those used for pumping liquid using underground pumps. The liquid columns constitute inlet conduits connected to the body of liquid, for bringing liquid into the system. These conduits may have a circular perimeter or any other perimeter shape. Whether vertical or angled relative to the ground, whether straight, bent or curved, any inlet conduit shape may form a suitable liquid column. The liquid columns are upwardly unidirectional for a substantial part of their length, one-way valves within the liquid columns allowing liquid to flow upwards in the liquid columns between the body of liquid and an actuated conduit. The actuated conduit contains liquid, connects the liquid columns and further connects to an output conduit. Additional one-way valves allow liquid to flow unidirectionally inward into the actuated conduit from each of the liquid columns. A switched valve within the actuated conduit, between the additional one-way valves, allows liquid coming from one of the liquid columns at a time to flow into the output conduit and out of the system. The switched valve has two reversible sides; one open side faces one of the liquid columns for allowing liquid to flow therefrom, and one closed side faces the other liquid column and blocks any liquid flow therefrom. The switched valve is controlled by liquid level detectors located near the top of each liquid columns. A starting system comprising a gas valve allows extracting gas from the upper connecting conduit. This action starts up the system by bringing liquid up in the liquid columns. Once the system is started, liquid flows down into the actuated conduit and into the output conduit, from one of the liquid columns facing the open side of the switched valve, as determined by a position of the switched valve. Because the two liquid columns are sealably connected by the upper connecting conduit that comprises gas, lowering of the liquid level at that liquid column creates a movement of the gas and a balancing effect, pumping liquid from the body of liquid through the other liquid column. When the liquid level at the top of the liquid column from which liquid is flowing down reaches a minimum level, the switched valve changes its position, allowing liquid to continue flowing into the actuated conduit and into the output conduit, this time from the other liquid column. Liquid is now drawn into the system from the body of liquid through the liquid column facing the side of the switched valve that is closed at that time.

Pumping liquid using a balancing effect may be applicable to various types of liquid sources. A body of liquid may comprise a lake, a river, an underground liquid table, or a reservoir. In some applications, liquid may be contaminated or polluted. The term 'liquid' is used throughout the present specification and claims for simplicity purposes, but it is not limited to pure or clean liquid. Referring to FIG. 1, there is shown a schematic diagram of an exemplary balancing liquid pumping system. The balancing liquid pumping system of FIG. 1 as illustrated is installed on solid ground and is used for pumping liquid from a liquid table. Application of the balancing liquid pumping system to this specific type of liquid body is solely for purposes of illustration and is not limiting, as the balancing liquid pump may be used for pumping from any body of liquid.

In FIG. 1, a system 100 comprises two liquid columns 102, 104 and an output conduit 106. The liquid columns 102, 104 are dug into the ground 108 and reach groundwater in the liquid table 110. For realizing the liquid columns 102, 104, solid pipes may be inserted into the ground, down to a level where they connect to the liquid table. As the liquid columns 102, 104 are dug, solid rock may be encountered, in which case a hollowed-out portion of the rock may substitute at least in part for the solid pipes. In an embodiment, insulation 103, 105 may be added onto the liquid columns 102, 104, in order to prevent winter damage to the liquid columns 102, 104. The insulation 103, 105 may extend below a lowest ground freeze line, for example up to 5 feet into the ground 108, and may cover any above ground part of the liquid columns 102, 104. Of course, additional insulation material (not shown) may cover any conduit being exposed to adverse climate conditions The liquid columns 102, 104 are sealably connected at their top to an upper connecting conduit 112 and near their top to an actuated conduit 114. The upper connecting conduit 112 is sealable and acts as a gas-liquid balancing conduit between the liquid columns 102 and 104. In a non-limiting embodiment, air is present in the upper connecting conduit 112. The actuated conduit 114 is also connected to the output conduit 106, optionally via a buffer reservoir 116 and a regulating valve 118 that together regulate a flow of liquid exiting the system 100. Liquid may only flow upward through these liquid columns 102, 104, which are inlet conduits allowing liquid to flow unidirectionally from the liquid table, because the liquid columns contain one-way valves 120, 122. As shown on FIG. 1, arrows on the valves 120, 122 indicate that liquid flow is only possible in the upward direction. Liquid drawn up from the liquid columns 102, 104 reach into lower parts the upper connecting conduit 112 that do not contain gas. For example, liquid may flow upward within the liquid column 102, through the valve 120, thereby filling in part the upper connecting conduit 112.

The actuated conduit 114 is formed of two unidirectional inward outlet conduits 114*a* and 114*b*, containing one-way valves 122, 126 allowing liquid to flow in the direction shown by arrows, and joining at a common switched valve 128. Liquid may for example flow downward from the upper connecting conduit 112 through the valve 122 and into the outlet conduit 114*a*. The actuated conduit 114 opens in one direction and closes in an opposite direction depending on a position of the switched valve 128. The switched valve 128 has two dual-purpose positions as one position (as shown in solid line) is at once opened toward the liquid column 102 and closed toward the liquid column 104 while another position (as shown in dashed line) is opened toward the liquid column 104 and closed toward the liquid column 102. The switched valve 128 may be under the control of a controller 130, which is itself connected to liquid level detectors 132, 134, located respectively proximate to the top ends of the liquid columns 102, 104. The liquid level detectors 132, 134 may for example be level float switches. In an embodiment, gas detectors may detect the presence of gas when the liquid level is below the detectors. In yet an embodiment, the detectors 132, 134 may be float switched having sufficient leverage to actuate cables (not shown) that directly actuate the switched valve 128, without control from a controller. The system 100 may operate with any suitable mechanism for detecting a liquid level and for actuating the switched valve 128. The controller 130, if present, may also control the regulating valve 118 via a signal going through a line A.

Three distinct reference liquid levels are shown, comprising a maximum liquid level 136, a minimum liquid level 138, and a starting liquid level 140. The same reference liquid levels apply on both sides of the system 100. Gas 142 is present within the upper connecting conduit 112, above liquid at any level. A gas valve 144 allows extracting some of the gas 142 from the upper connecting conduit 112, for starting and restarting the system 100. When the system 100 is not being started or restarted, the gas valve 144 may be tightly sealed. Because it is sealed, except when the gas valve 144 is opened, the upper connecting conduit 112 maintains a balance of gas and liquid in the system. An embodiment presented hereinbelow shows that the gas valve 144 may, in an aspect, be operated outside of starting or restarting phases.

The system 100 of FIG. 1 is shown in schematic form for illustration purposes and is not to scale. For example, an underground length of the liquid columns 102, 104 is sufficient to reach the liquid table 110 and is expected, in most cases, to be longer than an above ground height of any remaining parts of the system 110. Diameters of the output conduit 106, of the upper connecting conduit 112 and of the actuated conduit 114 may or may not be similar to those of the liquid columns 102, 104. Also, the actuated conduit 114 is shown in horizontal position, having a straight shape, the switched valve 128 being shown in its mid-length. The switched valve 128 could be positioned closer to one of the one-way valves 122 or 126, so the two outlet conduits 114*a* and 114*b* may have different lengths. The one-way valves 102, 124 are shown near the top of the liquid columns 102, 104, but may be located at any lower point within the liquid columns 102, 104. The actuated conduit 114 could have a curved shape and may be oriented downwards from its extremities towards the switched valve 128. The upper connecting conduit 112 may have other shapes than the illustrated semi-circular shape. Other variations of various shapes of elements of the system 100 will come to mind to those of ordinary skill in the art.

In operation, the system 100 may be started by using a gas pump (not shown) for extracting some of the gas 142 from the upper connecting conduit 112 via the gas valve 144. This gas aspiration creates a negative pressure within the system 100, whereby groundwater from the liquid table 110 is pumped upwards within the liquid columns 102, 104 and through the one-way valves 120, 124 until the starting liquid level 140 is reached. Those of ordinary skill in the art of liquid wells will appreciate that other starting systems may alternatively be used to raise liquid level in at least one of the liquid columns 102, 104, during a starting phase of the system 100. Assuming that switched valve 128 is initially in the position as shown (solid line), some liquid may flow through the one-way valve 126 into the actuated conduit 114 (into the outlet conduit 114*b*), but the switched valve 128 blocks liquid coming through the one-way valve 126 from flowing any further. More liquid may flow through the one-way valve 122, into the actuated conduit 114 (through the outlet conduit 114*a*), and then through the switched valve 128, which is open on that side of the actuated conduit 114, filling the buffer reservoir 116. At that time, the controller 130 may keep the regulating valve 118 in a closed position, preventing liquid from flowing out of the system through the output conduit 106.

In an embodiment, the one-way valves 122, 126 may be calibrated such that they remain closed and prevent any liquid from entering the actuated conduit 114 while there exists a negative gas pressure within the upper connecting conduit 112. In another embodiment, the one-way valves 122, 126 may be electrically controlled and the controller 130 may control opening and closing of the one-way valves 122, 126, maintaining them closed during the starting phase of the system 100. In yet another embodiment, the actuated conduit 114 and the switched valve 128 may be substituted by two separate conduits and valves (not shown) that both connect to the buffer reservoir 116 but not to each other. In that case, the valves within the separate conduits may have one open and one closed position, being controlled by the controller 130 to remain both closed during the starting phase. In these embodiments, the controller 130 does not control the regulating valve 118. The buffer reservoir 116 and the regulating valve 118 may then be absent or may be used for smoothing the flow of liquid exiting the system through the output conduit 106.

When liquid reaches the starting liquid level 140, as detected by the two liquid level detectors 132, 134, the controller 130 closes the gas valve 144 via a signal going through a line B, thereby sealing the upper connecting conduit 112. The controller 130 also opens the regulating valve 118, creating a liquid flow down from the buffer reservoir 116 through the output conduit 106. Because of the position of the switched valve 128, liquid then flows through the one-way valve 122 into the actuated conduit 114 and into the buffer reservoir 116. As mentioned hereinabove, in some embodiments, it is the end of the starting phase of the system 100 that causes opening of the one-way valve 122, either by the action of liquid pressure within the column 102, in the absence of gas aspiration at the gas valve 144, or under control of the controller 130. In another embodiment, valves within separate conduits instead of the actuated conduit 114 are opened and closed as required based on measurements from the liquid level detectors 132, 134. As a consequence of the opening of the regulating valve 118 or other effect from the end of the starting phase, the liquid level at the top of the liquid column 102 goes down. Because the upper connecting conduit 112 is sealed, this lowering of the liquid level at the top of the liquid column 102 moves gas within the upper connecting conduit 112, creating a compensation effect by pumping liquid coming from the liquid table 110, upwards into the liquid column 104 and through the one-way valve 124. Hence, as the liquid level goes down near the top of the liquid column 102, this is balanced by the liquid level going up near the top of the liquid column 104. The liquid level detector 132 eventually detects that the liquid level of the liquid column 102 has reached the minimum level 138. The controller 130, based on a reading from the liquid level detector 132, switches the switched valve 128 from one position (solid line) to an opposite position (dashed line). As mentioned hereinabove, in an embodiment, the liquid level detector 132 may actuate the switched valve 128 using a cable (not shown), in the absence of a controller. Liquid stops flowing through the one-way valve 122 and starts flowing through the one-way valve 126. The liquid level goes down at the top of the liquid column 104 and this is compensated by liquid coming from the liquid table 110 through the liquid column 102.

Liquid is thus pumped up through the liquid columns 102, 104, one after the other, and exited through the output conduit 106 for a few cycles, until this balancing sequence stops due to inherent losses within the system 100 or losses at an interface between the system 100 and the liquid table 110. For example, the cycle may be attenuated when the switched valve 128 moves between its two positions, as liquid may transitionally flow through both one-way valves 122 and 126 at the same time. The two liquid level detectors 132, 134 may eventually both signal low liquid levels to the controller 130. At that time, the controller 130 closes the regulating vale 118 and commands renewed gas aspiration at the gas valve 144, thereby restarting the system 100.

Those of ordinary skill in the art will readily appreciate that the system 100 requires some modest energy input in order to maintain its operation. Energy may be input into the system 100, upon starting or restarting phases, by way of gas aspiration at the gas valve 144. In an embodiment, the system 100 may further comprise a gas pressure detector 145, operably connected to the controller 130. The gas pressure detector 145 monitors an average differential gas pressure, indicative of a difference between a negative pressure within the upper connecting conduit 112 and an atmospheric pressure. The gas pressure detector 145 reports its reading to the controller 130. The controller 130 may initiate starting or restarting of the system 100 based on a low differential gas pressure signal received from the gas pressure detector 145. Alternatively, while the balancing sequence is under way, the controller 130 may command some gas aspiration at the gas valve 144 upon a reduced differential gas pressure reading from the gas pressure detector 145. Compensation for gas or liquid leaks may thus occur without stopping the balancing sequence, thereby providing substantially continuous pumping in the system 100, without need for frequent restarts.

Figure 2:
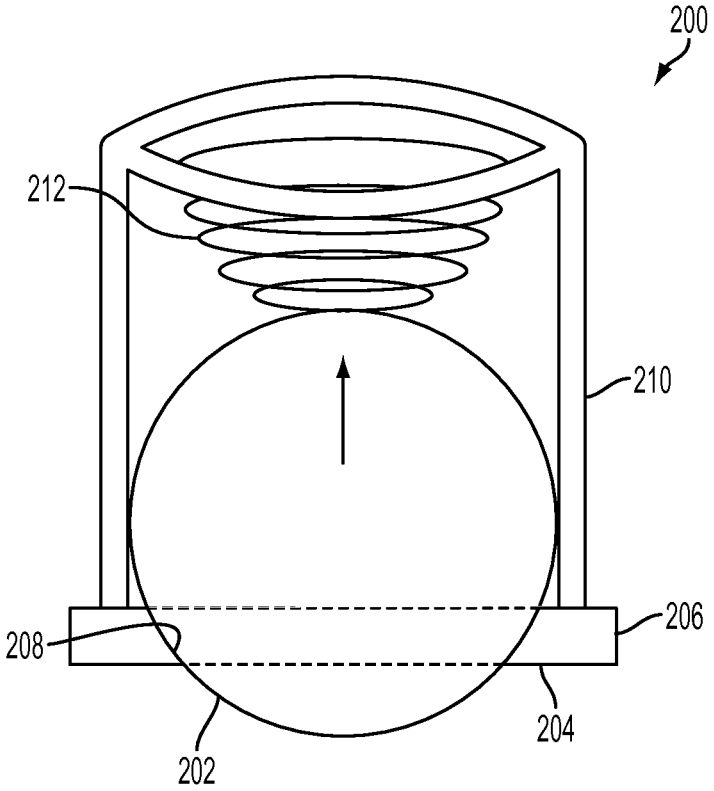
FIG. 2 is a schematic diagram of an exemplary one-way valve.

Referring now to FIG. 2, there is shown schematic diagram of an exemplary one-way valve. A one-way valve 200 comprises a rubber ring 204 mounted within a frame 210 and a ball 202, capable of moving on one side of the rubber ring 204, in the direction shown by the arrow. The rubber ring 204 maintains, on its outer edge 206, a sealing contact with an internal perimeter of a conduit (not shown) in which it is inserted. An inner edge 208 of the rubber ring 204 sealably connects with the ball 202 when in closed position. The inner edge 208 of the rubber ring 204 hermetically mates with the ball 202 to seal the one-way valve 200. The rubber ring 204 also serves in absorbing shocks when coming in contact with the ball 202. The frame 210 maintains the ball 202 within proximity of the rubber ring 204 when in open position. In a vertically oriented conduit such as the liquid columns 102, 104 of FIG. 1, in which liquid is only allowed to flow upwards, gravity and/or liquid pressure above the one-way valve 200 may return the ball 202 in the closed position when no liquid flow is present. Still in the particular case of a vertically oriented conduit, the ball 202 may, in an embodiment, have a lesser density than liquid so that it can float upward, allowing an easy liquid flow, unless liquid pressure above the one-way valve 200 forces closing of the valve. For better sealing or for other orientations, a spring 212 may return the ball 202 in closed position, against the rubber ring 204, in the absence of a liquid flow.

Referring back to FIG. 1, in an embodiment and in the case of the one-way valves 122, 126 located within the actuated conduit 114, the spring 212 may be calibrated so that the ball 202 remains in closed position, in contact with the rubber ring 204, while the system 100 is in a starting phase. While gas is being extracted through the gas valve 144, the net liquid pressure applied on the one-way valves 122, 126 is relatively low and springs 212, in each of these valves, maintain the valves in their closed positions. Liquid pressure within the system 100 reaches equilibrium as soon as the starting phase has ended. One of the one-way valves 122, 126, facing an open side of the switched valve 128, opens and lets liquid flow through. The other one-way valve is facing a closed side of the switched valve 128 so no liquid may flow through.

Figure 3:
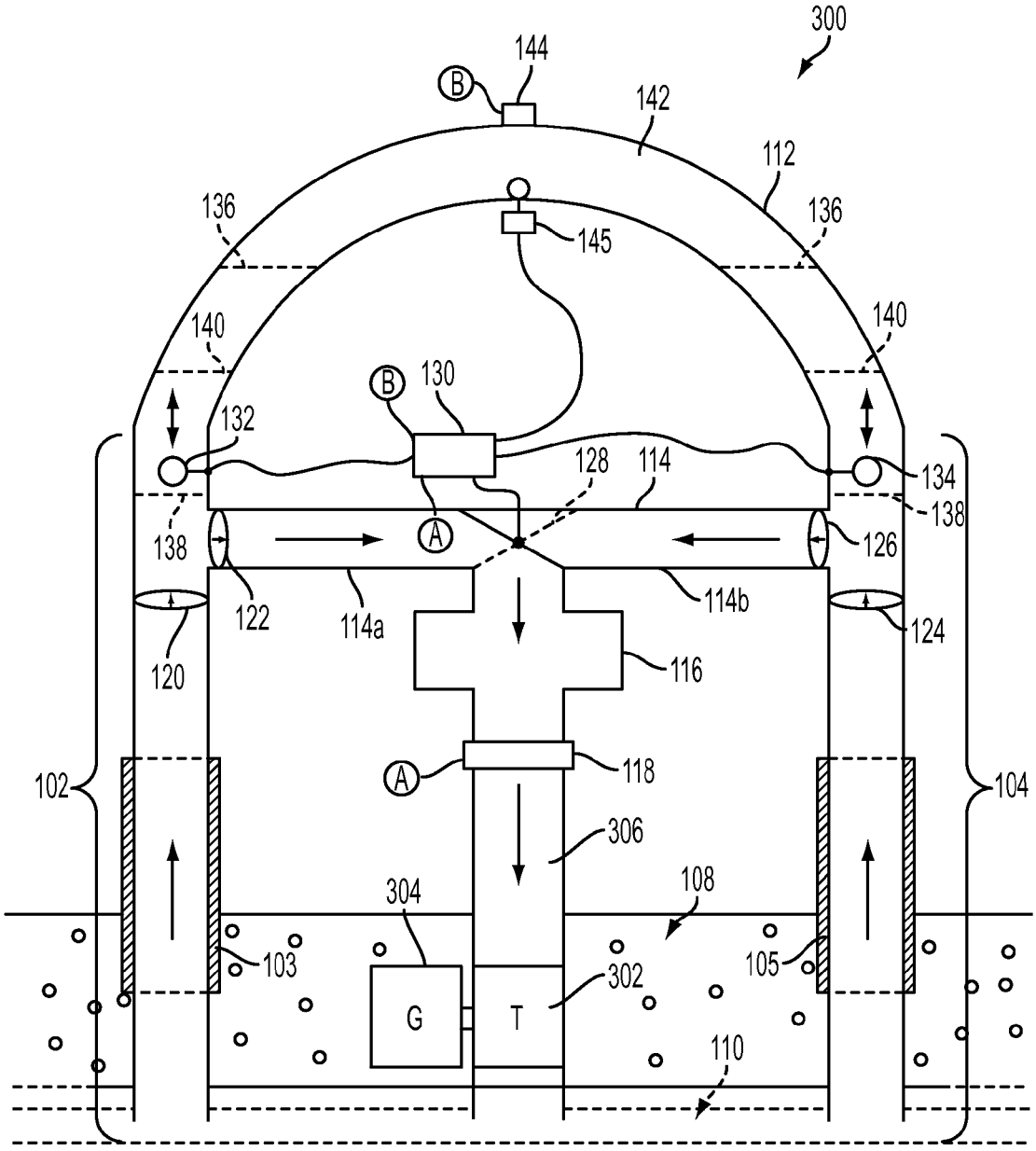
FIG. 3 is a schematic diagram of an alternative liquid pumping system coupled to an electric generator.

Liquid exiting from the output conduit 106 of FIG. 1 may be used for domestic, industrial or agricultural purposes. A variant of the system 100 may be used for energy production. FIG. 3 shows a schematic diagram of an alternative liquid pumping system coupled to an electric generator. A system 300 is similar to the system 100 of FIG. 1, in which an output conduit 306 is connected to a liquid turbine 302, which is itself connected to an electric generator 304. The liquid turbine 302 is actuated by liquid flow coming down through the output conduit 306. The output conduit 306 optionally returns groundwater to the liquid table 110. This non-limitative embodiment of the system 300 prevents depletion of this natural resource. Other cases may apply wherein liquid may be used for other domestic, industrial or agricultural purposes, in which cases the output conduit 306, the liquid turbine 302 and the electric generator 304 remain above the ground 108. Of course, a higher liquid pressure is achieved at the liquid turbine 302 when it is located immediately above the liquid table 110.

Electrical energy consumed by the system 300 is limited to the starting phase, when gas is extracted through the gas valve 144 or when an alternate starting system is in use, save for negligible energy spent in the controller 130, in the liquid level detectors 132, 134, in the switched valve 128, and in the regulating valve 118 if applicable. A net energy budget from electricity generated at the electric generator 304 minus the energy spent in the system 300 is positive, much like in the case of a heat pump producing more heat energy than an amount of electrical energy required to drive its compressor. The system 300 extracts natural energy and converts it into electrical energy, much like a windmill does.

Those of ordinary skill in the art will realize that the description of the balancing liquid pump and system for pumping liquid are illustrative only and are not intended to be in any way limiting. Other embodiments will readily suggest themselves to such skilled persons having the benefit of this disclosure. Furthermore, the disclosed system can be customized to offer valuable solutions to existing needs and problems of liquid pumping systems and apparatuses.

In the interest of clarity, not all of the routine features of the implementations of the balancing liquid pump and system for pumping from a body of liquid are shown and described. It will, of course, be appreciated that in the development of any such actual implementation of the balancing liquid pump and system for pumping liquid, numerous implementation-specific decisions must be made in order to achieve the developer's specific goals, such as compliance with application-, system- and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of liquid pumping systems having the benefit of this disclosure.

Although the present disclosure has been described hereinabove by way of non-restrictive illustrative embodiments thereof, these embodiments can be modified at will within the scope of the appended claims without departing from the spirit and nature of the present disclosure.

What is claimed is:

1. A system for pumping liquid comprising:

two liquid columns for reaching a body of liquid at their bottom, each liquid column comprising a liquid level detector and a unidirectional valve allowing liquid to flow upward;

an upper conduit for sealably connecting to tops of the two liquid columns so as to form a continuous conduit between the unidirectional valves of the two liquid columns;

a sealable gas valve for extracting gas from the upper conduit;

an actuated conduit having ends connecting to each of the two liquid columns above their unidirectional valve, the actuated conduit comprising, at each end, a unidirectional valve allowing liquid to flow inward from each of the two columns, wherein the unidirectional valves of the actuated conduit are located on a different axis than the axis on which the unidirectional valves of the two liquid columns are arranged the actuated conduit further comprising, between its two unidirectional valves, a switched valve allowing liquid to flow out of the system from one end of the liquid columns at a time; and a controller connected to the liquid level detectors and to the sealable gas valve, for controlling the switched valve and the sealable gas valve so that opening of the gas valve allows extraction of a gas from the upper conduit via the sealable gas valve to cause a rise of liquid in each of the two liquid columns to a starting level, sealing of the gas valve causes liquid from one of the liquid columns to flow out of the system through the actuated conduit and through the switched valve; and the controller further configured to switch the switched valve to allow liquid to flow from another one of the liquid columns as the liquid level in the one of the liquid columns reaches a minimum level.

2. The system of claim 1, comprising an output conduit connected to the switched valve for collecting liquid flowing out of the system.

3. The system of claim 2, comprising a turbine and a generator connected to each other, wherein liquid flowing out of the system through the output conduit actuates the turbine for producing electricity at the generator.

4. The system of claim 2, wherein liquid output from the output conduit is for domestic, industrial or agricultural use.

5. The system of claim 1, comprising a buffer reservoir connected to the switched valve for collecting liquid flowing out of the system.

6. The system of claim 5, comprising a regulating valve connected to the buffer reservoir for regulating a flow of liquid out of the system.

7. The system of claim 6, wherein the regulating valve prevents liquid from flowing out of the system while gas is extracted from the upper conduit.

8. The system of claim 6, wherein the regulating valve and the buffer reservoir smooth out the flow of liquid out of the system.

9. The system of claim 1, wherein each unidirectional valve comprises a rubber ring for sealably connecting to an internal perimeter of one of the conduits or of one of the columns, and a ball located on one side of the rubber ring, the ball allowing a liquid flow when separated from the rubber ring, and preventing a liquid flow when mated with the rubber ring.

10. The system of claim 9, wherein the unidirectional valve further comprises a spring for maintaining the ball against the rubber ring in the absence of a liquid flow.

11. The system of claim 1, wherein the unidirectional valve in each of the liquid columns comprise a rubber ring and a floating ball, closing of the unidirectional valve in the absence of an upward liquid flow being caused by liquid pressure from above the unidirectional valve causing contact of the floating ball on the rubber ring.

12. The system of claim 1, wherein the liquid flows out of the system in a continuous manner after a starting phase.

13. A balancing liquid pump, comprising:

a sealable gas-liquid balancing conduit;

two inlet conduits for connecting to a body of liquid at their bottom in unidirectional upward direction and for connecting to the gas-liquid balancing conduit at their top, wherein the sealable gas-liquid balancing conduit forms a continuous path connecting the two inlet conduits;

two unidirectional outlet conduits, each outlet conduit for connecting at one end to one of the inlet conduits and at another end to a common switched valve, the switched valve allowing liquid to flow out of the pump from one of the two inlet conduits at a time;

a starting system for initiating a flow of liquid from the body of liquid and for raising a level of liquid in the two inlet conduits;

wherein as liquid flows out of the pump from one of the inlet conduits, a level of liquid in the one of the inlet conduits goes down, and gas in the gas-liquid balancing conduit follows the level of liquid in the one of the inlet conduit;

whereby movement of the gas in the gas-liquid balancing conduit pumps liquid from the body of liquid into another one of the inlet conduits.

14. The pump of claim 13, comprising liquid level detectors in each inlet conduit, wherein detection of a low liquid level in the one of the inlet conduits is used to control a change of position of the switched valve for blocking a liquid flow from the one of the inlet conduits and allowing liquid to flow out from the other one of the inlet conduits.

15. The pump of claim 14, comprising a controller connected to the liquid level detectors for controlling the starting system and the switched valve.

16. The pump of claim 13, wherein a liquid flow out of the pump is prevented during a starting phase.

17. The pump of claim 16, wherein the switched valve prevents a liquid flow out of the pump during the starting phase.

18. The pump of claim 13, wherein the starting system comprises a gas valve and a gas pump for extracting gas from the gas-liquid balancing conduit during a starting phase.

19. The pump of claim 13, wherein each of the two inlet conduit comprises a unidirectional valve having a rubber ring and a floating ball, closing of the unidirectional valve in the absence of an upward liquid flow being caused by liquid pressure from above the unidirectional valve causing contact of the floating ball on the rubber ring.

20. The pump of claim 13, wherein the liquid flows out of the pump in a continuous manner after a starting phase.

* * * * *